US006691627B2

(12) United States Patent
Einsel et al.

(10) Patent No.: US 6,691,627 B2
(45) Date of Patent: Feb. 17, 2004

(54) ATTACHABLE, HEIGHT ADJUSTABLE LAWN CHAIR TABLE

(76) Inventors: Elizabeth Einsel, 383 Sunnyhill Ave., Franklinville, NJ (US) 08322; Mary Holben, 18 Colonial Ave., Haddonfield, NJ (US) 08033

( * ) Notice: Subject to any disclaimer, the term of this patent is extended or adjusted under 35 U.S.C. 154(b) by 74 days.

(21) Appl. No.: 09/828,759

(22) Filed: Apr. 9, 2001

(65) Prior Publication Data

US 2002/0144635 A1 Oct. 10, 2002

(51) Int. Cl.[7] ..... A47B 5/02

(52) U.S. Cl. ..... 108/157.11; 297/160; 297/161; 108/147.21

(58) Field of Search ..... 108/147.12, 147.21, 108/147.19, 147.2, 152, 117, 157.11; 297/160, 161

(56) References Cited

U.S. PATENT DOCUMENTS 3,094,080 A * 6/1963 Shannon ..... 108/147.18
3,239,272 A * 3/1966 Wilkins ..... 297/160 X
4,609,224 A 9/1986 Coggins
4,803,930 A * 2/1989 Crocoli ..... 108/117 X
5,038,451 A 8/1991 Smith
5,251,956 A 10/1993 Hofmeyer
5,257,765 A 11/1993 Halls
5,292,172 A 3/1994 Watts
D346,516 S 5/1994 D'Anna
5,865,124 A 2/1999 Wroe
5,873,624 A 2/1999 Simpson
5,918,550 A * 7/1999 Weir et al. ..... 108/157.11 X
5,996,507 A * 12/1999 Joseph ..... 108/147.2 X

* cited by examiner

*Primary Examiner*—John G. Weiss
*Assistant Examiner*—Michael J. Fisher

(57) ABSTRACT

An attachable table for a lawn chair with a hinged (9) and adjustable leg (7). The tabletop (6) attaches to any lawn chair with two Velcro straps (10), which are put through slots (1) at one end of the tabletop. The height is acquired by attaching the flat slotted (7) leg (2) to a hinged pierced flat piece (8) attached to the opposite side of the tabletop, with a carriage bolt (4) and a wing nut (5). The leg adjusts to the desired height as needed for any individual lawn chair by sliding the two flat slotted leg pieces together and then tightening the carriage bolt and wing nut together. All of the pieces are constructed of plastic except the carriage bolt and wing nut, which is made of metal. All of the corners are rounded and the edges are beveled to eliminate sharpness.

1 Claim, 4 Drawing Sheets

ATTACHABLE, HEIGHT ADJUSTABLE LAWN CHAIR TABLE

CROSS-REFERENCE TO RELATED APPLICATIONS

Not applicable

BACKGROUND

1. Field of Invention

The present invention relates to an attachable, height adjustable table for an outside lawn chair and particularly pertains to providing a convenient removable device, which can be folded and easily transported.

2. Description of Prior Art

The use of lawn chair tables is known in the prior art. More specifically, lawn chair tables heretofore devised and utilized for the purpose of placing items for easy retrieval on a tabletop basically of familiar, expected, and obvious structural configurations, not withstanding the myriad of designs encompassed by the crowded prior art which has been developed for the fulfillment of countless objectives and requirements.

Originally lawn chair tables were invented, but were independent from the lawn chair. Therefore, people do not have the convenience of transporting fewer pieces of lawn furniture to hold small items such as drinks, food, books, etc.

Thereafter, inventors created chairs with permanently attached tables that may not be suitable for outdoor use due to the materials of which they are constructed or chairs that do not have removable or height adjustable tables. By way of example, U.S. Pat. No. 5,251,956 to Willis J. Hofmeyer (1993) discloses a foldable table attachment for a collapsible chair for outside use; however, this is a low recliner and the table is not removable. U.S. Pat. No. 5,873,624 to Rick J. Simpson (1999) shows a disclosure of a Folding lawn chair with a tray, which is made of metal tubing and has a non-removable tray making it cumbersome and hard to carry. U.S. Pat. No. 5,865,124 to Dwight W. Wroe (1999is an attachable tray, which requires quite a bit of assembling and does not fold up for storage. This tray is comprised of several pieces which have to be taken apart for storage leaving a chance of losing some of its parts.

While these devises fulfill their respective, particular objectives and requirements, the aforementioned patents do not describe an attachable, height adjustable table, which can be folded and easily transported.

In this respect, the attachable, height adjustable lawn chair table according to the present invention substantially departs from the conventional concepts and design of the prior art, and in doing so provides an apparatus primarily developed for the purpose of providing an attachable, adjustable lawn chair table.

Therefore, it can be appreciated that there exists a continuing need for a new and improved lawn chair table, which can be used for providing a lawn chair table that can be attached and adjusted for desired height. In this regard, the present invention substantially fulfills this need.

SUMMARY

In accordance with the present invention, an improved lawn chair attachable, height adjustable table. As such, the general purpose of the present invention, which will be subsequently in greater detail, is to provide a new and improved lawn chair attachable, height adjustable table and method of use.

The present invention essentially comprises an attachable, height adjustable table for a lawn chair with a hinged and adjustable leg. The tabletop attaches to any lawn chair with two flexible Velcro straps, which are put through slots at one end of the tabletop. The height is acquired by attaching a flat slotted leg to a hinged pierced flat piece attached to the opposite side of the tabletop, with a carriage bolt and a wing nut, which is used to tighten the leg to prevent slipping. This leg style is an improvement because it is flat and unlike a cylinder shape, sand and dirt cannot become trapped inside preventing the proper functions of the mechanics. The leg adjusts to the desired height as needed for an individual lawn chair by sliding the two flat slotted leg pieces together and then tightening the carriage bolt and wing nut together. All of the pieces are constructed of Plexiglas, Lexan or molded plastic except the carriage bolt and wing nut, which can also be made of galvanized steel. All of the corners and edges are rounded and beveled to help reduce sharpness and prevent injuries.

There has thus been outlined, the more important features of the invention in the order that detailed description thereof that follows may be better understood and in order that the present contribution to the art may be better appreciated. There are, of coarse, additional features of the invention that will be described hereinafter and which will form the subject matter of the claims appended hereto.

In this respect, before explaining at least one embodiment of the invention in detail, it is to be understood that the invention is not limited in its application to the detail of construction and to the arrangements of the components set fourth in the following description or illustrated in the drawings. The invention is capable of other embodiments and of being practiced and carried out in many ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the design of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved attachable, height adjustable lawn chair table, which may be easily and efficiently manufactured and marketed.

An even further object of the present invention is to provide a new and improved attachable, height adjustable lawn chair table which is susceptible of low cost of manufacture with regard to both materials and labor, and which accordingly is then susceptible of low prices of sale to the consuming public, thereby making such, height adjustable economically available to the public.

Even still another object of the present invention is to provide an attachable, height adjustable lawn chair table that is portable and can be easily folded and stored.

Lastly, it is an object of the present invention to provide a new and improved attachable, height adjustable lawn chair table with a hinged and adjustable leg, a tabletop that attaches to any lawn chair with two Velcro straps, which are put through slots at one end of the tabletop. Height levels can be acquired by attaching a flat slotted leg to a hinged pierced flat piece attached to the opposite side of the tabletop, with a carriage bolt and a wing nut. The leg can adjust to the desired height as needed for an individual lawn chair by sliding the two flat slotted leg pieces together and then tightening the carriage bolt and wing nut together to form an attachable, height adjustable table for a lawn chair.

These together with other objects of the invention, along with various features of novelty, which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

OBJECTS AND ADVANTAGES

Accordingly, besides the objects and advantages of the attachable, height adjustable lawn chair tables described in our above patent, several objects and advantages of the present invention are:

(a) to provide an attachable height adjustable lawn chair table which is light and can be easily carried and transported;

(b) to provide an attachable height adjustable lawn chair table which can be easily attached with Velcro straps;

(c) to provide an attachable height adjustable lawn chair table that can be adjusted to several desired heights;

(d) to provide an attachable height adjustable lawn chair table that can be attached to various lawn chairs;

(e) to provide an attachable height adjustable lawn chair table that can be easily assembled;

(f) to provide an attachable height adjustable lawn chair table that can be hung on the back of a lawn chair when the leg is folded;

(g) to provide an attachable height adjustable lawn chair table which is small enough to be easily stored.

(h) to provide an attachable height adjustable lawn chair table that is economical These together with other objects of the invention, along with various features of novelty, which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DRAWING FIGURES

In the drawings, closely related figures have the same number but different alphabetical suffixes.

Figure 6:
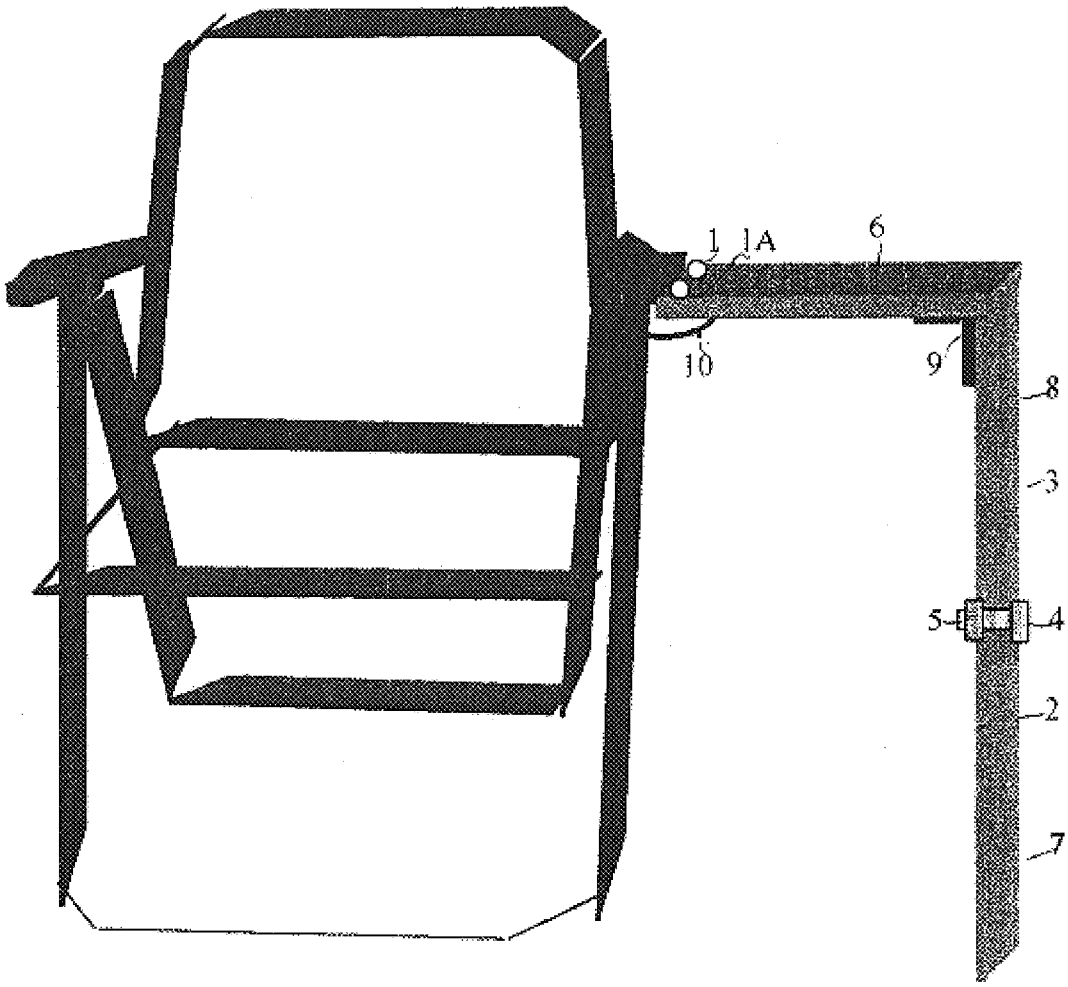

FIG. 6. shows an illustration of the present invention attached to a chair.

REFERENCE NUMBERS IN DRAWINGS

1. W 1¼"×H ¼" Slot
1A. W 1¼×H ¼" Slot
2. L 6⅜" ×W ¼"Slot
3. ¼" DIA. Hole
4. ¼"–20"×1" Carriage Bolt
5. ¼–20" Wing Nut
6. 15"×12" Table Top
7. 16"×4" Leg
8. 7½"×4" Support attached to table top with hinge
9. 2"×4" Hinge
10. 1"×10" Velcro Straps ×2

Figure 1:
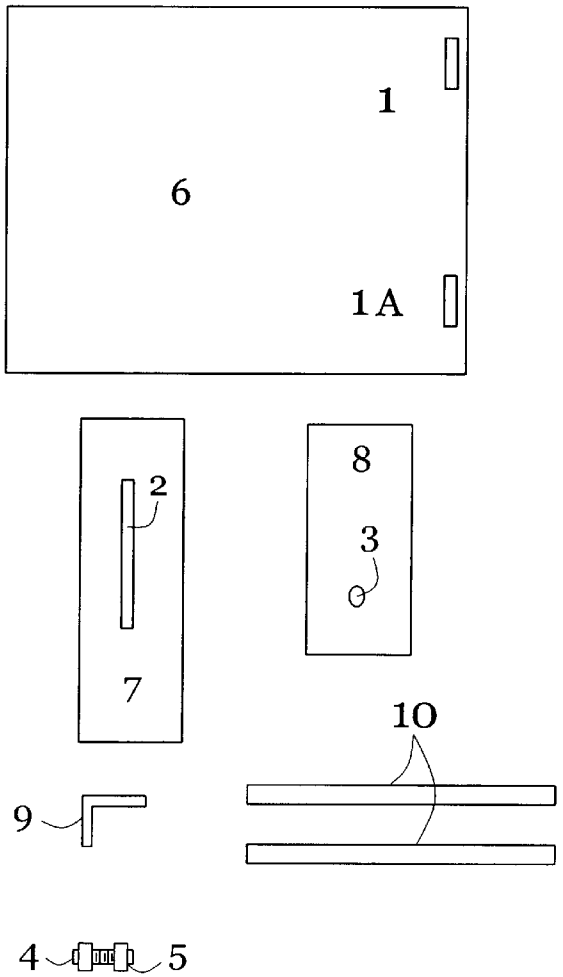
FIG. 1 is a parts list of all pieces including sizes and dimensions needed to construct the table.
Figure 2:
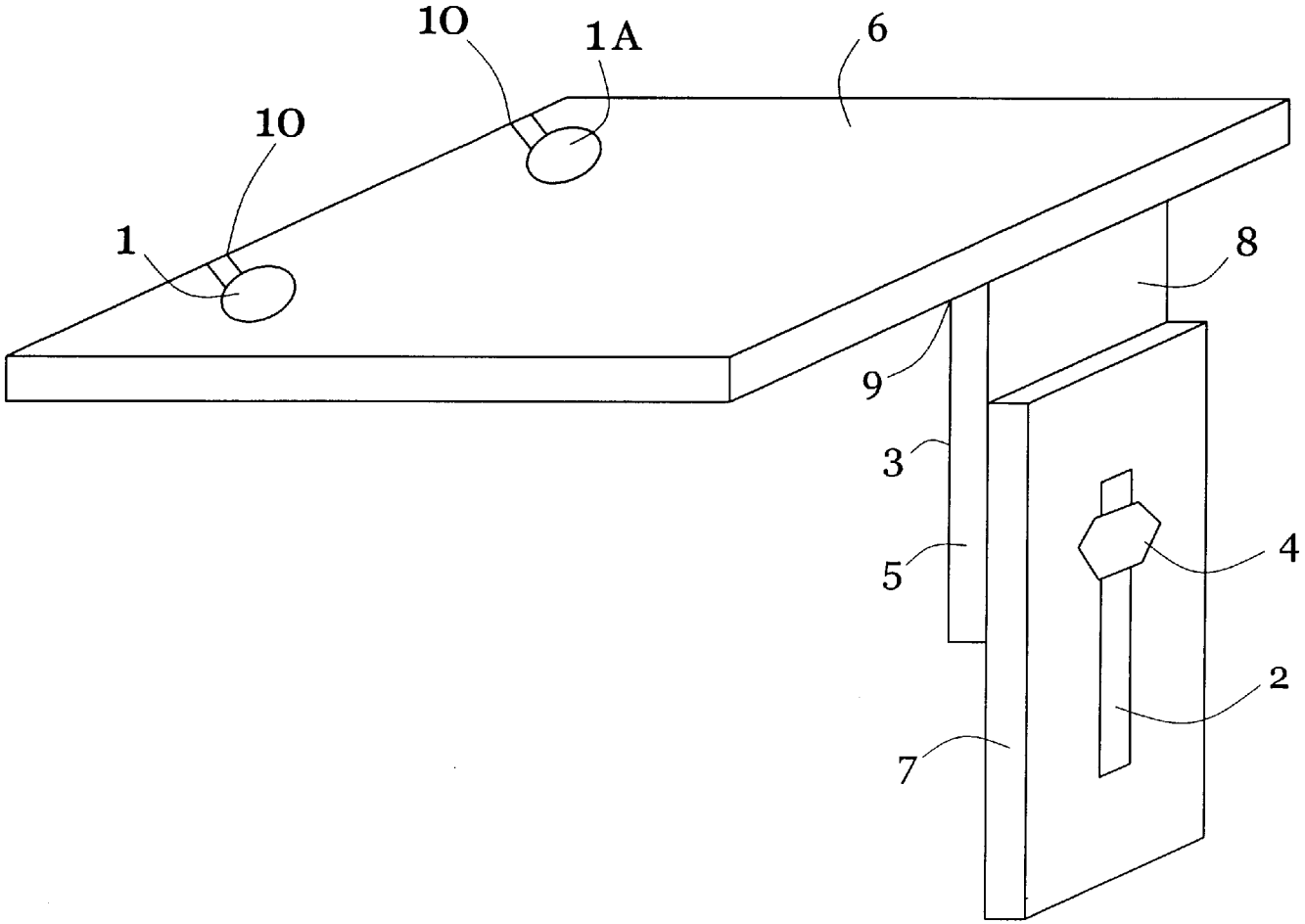
FIG. 2 is a side view of the present invention fully assembled without the flexible looped straps, which attach the table to the lawn chair.

Description—FIGS. 1 and 2 Preferred Embodiment

A preferred embodiment of the construction of the present invention is illustrated in FIG. 1 (parts name) and FIG. 2 (assembled table). The closure has a flat top 6 15"×12" used as the tabletop, which has rounded corners and beveled edges. Two slots 1 & 1A W 1¼"×H¼" at one end of the tabletop are used for the purpose of attaching the table with two flexible lopped straps 10 to a lawn chair. In the preferred embodiment the tabletop and leg parts are made of plastic, however the parts can also be made of other materials such as Plexiglas, Lexan or molded plastic.

At the other end of the tabletop is a hinge 9 2"×4", which attaches the tabletop 6 15"×12" and a top leg part 8 7½×4" that has a hole 3 ¼" DIA. For the purpose of attaching a longer leg 7 16"×4" with slot 2 ¼" to the hinged leg 8 7½"×4" with a carriage bolt 4 ¼–20×1" and a wing nut 5 ¼"–20". Carriage bolt and wing nut are made of galvanized steel or plastic. FIG. 8 7½"×4" and FIG. 7 16"×4" aligned and tightened together with the carriage bolt 4 ¼"–20×1" and wing nut 5 ¼"–20 " to attain desired height of the lawn chair table.

FIG. 3–6—Additional Embodiments

Figure 3:
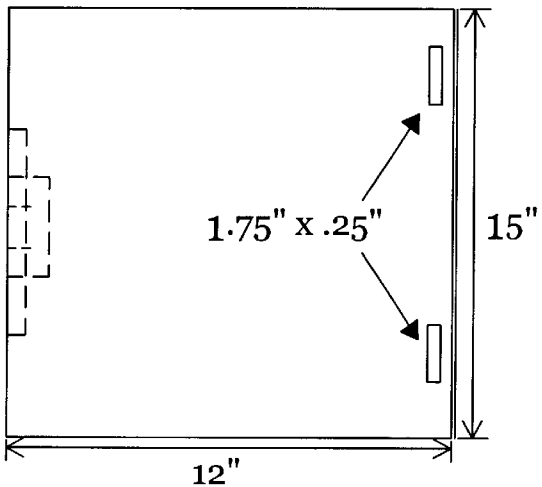
FIG. 3 is a top view of the present invention of FIG. 2.
Figure 4:
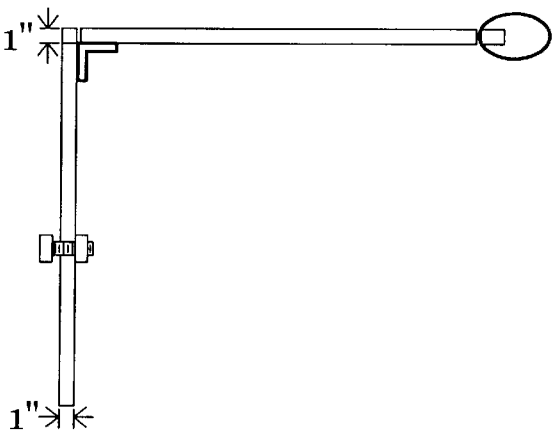
FIG. 4 is a front view of the present invention in an open and operable orientation.
Figure 5:
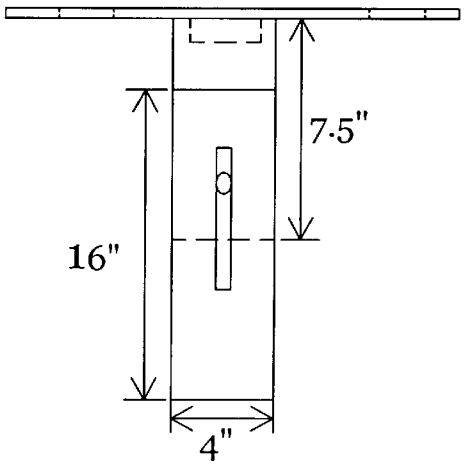
FIG. 5 shows a side view of the present invention with its height adjustable mechanisms.

Additional embodiments are shown in FIGS. 3, 4, 5 and 6 in each case the attachable, height adjustable lawn chair table is shown at a different angle. FIG. 3 shows the tabletop from an overlooking top view: in FIG. 4 the table is showing a front view with the Velcro straps attached to the tabletop: FIG. 5 is a side view showing the legs 8 7½"×4" and 7 16"×4" joined together with the carriage bolt 4 ¼"–20×1" and a wing nut 5 ¼"-20": FIG. 6 is an illustration of the instant invention attached to a chair. All of the corners of the legs are rounded and the edges are beveled to help prevent injuries.

Advantages

From the described above, a number of advantages of our attachable, height adjustable lawn chair become evident:

(a) A table that can be easily attached to a lawn chair without having to carry an extra piece of furniture.

(b) Velcro straps make attaching this table to a lawn chair quick and easy.

(c) This table can be adjusted to several desired heights of a lawn chair lawn chairs.

(d) Various types of lawn chairs can be used with the attachable, height adjustable lawn chair table.

(e) The attachable, height adjustable lawn chair table is very easy to assemble.

(f) Folding the leg up and hanging the table on the back of the lawn chair allows easy storage.

(g) The attachable, height adjustable lawn chair table is small and lightweight.

(h) This is an economical piece of furniture that will hold up well in outdoor climates.

Conclusion, Ramifications, and Scope

Accordingly, the reader will see that the attachable, height adjustable lawn chair table of this invention can be used on various lawn chairs with ease, it will be easy to transport, light to carry and simple to attach. This will be a handy piece of furniture for the beach, parks, backyards, picnics and many other places. In addition, this table can be attached to the back of the chair for convenient storage when not in use. Furthermore the attachable, height adjustable lawn chair table has the additional advantages that it allows the user to place small items on a table instead of under the lawn chair or on the ground.

it provides a surface for items at arms length.

it provides a personal table for each chair instead of having one independent table between two chairs.

It saves storage space in garages and sheds due to its ability to be stored on the backs of the folded lawn chairs.

Although the description above contains much specificity, these should not be construed as limiting the scope of the invention but as merely providing illustrations of some of the presently preferred embodiments of this invention. For example: the tabletop could have other shapes such as oval, rectangular or triangular; the hinge could be made of plastic, metal or clothe; The table could come in many different colors.

Thus the scope of the invention should be determined by the appended claims and their legal equivalents, rather than by the examples given.

What is claimed as being new and desired to be protected by Letters Patent of the United States is as follows:

1. A height adjustable table for attachment to a chair arm comprising;

a table top with beveled edges and rounded corners, hinged leg support with a first and second support member, said first support member being pivotally attached near a first edge of the table top, a slot longitudinally therethrough in the center of the first member, said second support member having a slot longitudinally therethrough in the center of the second member, a carriage bolt and wing nut inserted into the slots joining the support members and allowing for adjustability of the height of the leg, two slots along a second edge of the table top opposite the first edge, a flexible strap with two ends inserted into each slot wherein each strap has an means for attachment along each end thereof that adjustably attach the ends together for attaching the table to various sized chair arms.

* * * * *